US009441883B2

(12) United States Patent
Kim et al.

(10) Patent No.: US 9,441,883 B2
(45) Date of Patent: Sep. 13, 2016

(54) LAUNDRY TREATING MACHINE

(71) Applicants: Hyojun Kim, Seoul (KR); Woore Kim, Seoul (KR); Junghoon Lee, Seoul (KR)

(72) Inventors: Hyojun Kim, Seoul (KR); Woore Kim, Seoul (KR); Junghoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 559 days.

(21) Appl. No.: 13/747,996

(22) Filed: Jan. 23, 2013

(65) Prior Publication Data

US 2013/0212894 A1 Aug. 22, 2013

(30) Foreign Application Priority Data

Feb. 22, 2012 (KR) ..... 10-2012-0017878

(51) Int. Cl.

| | |
|---|---|
| ***F26B 21/06*** | (2006.01) |
| ***F26B 21/00*** | (2006.01) |
| ***D06F 58/22*** | (2006.01) |
| ***D06F 39/10*** | (2006.01) |
| *D06F 39/08* | (2006.01) |
| *D06F 25/00* | (2006.01) |

(52) U.S. Cl.

CPC ..... *F26B 21/003* (2013.01); *D06F 39/10* (2013.01); *D06F 58/22* (2013.01); *D06F 25/00* (2013.01); *D06F 39/088* (2013.01)

(58) Field of Classification Search

CPC ..... F26B 21/003; D06F 58/22; D06F 25/00; D06F 39/088; D06F 39/10; D06F 58/24

USPC ..... 34/82

See application file for complete search history.

(56) References Cited

U.S. PATENT DOCUMENTS

| | | | | |
|---|---|---|---|---|
| 3,959,891 | A * | 6/1976 | Burkall | D06F 58/22 34/604 |
| 2004/0221474 | A1 | 11/2004 | Slutsky et al. | |
| 2005/0252029 | A1* | 11/2005 | Kim | D06F 25/00 34/596 |
| 2006/0075577 | A1* | 4/2006 | Jeong | D06F 25/00 8/158 |
| 2006/0123854 | A1* | 6/2006 | Hong | D06F 25/00 68/19.1 |
| 2010/0155326 | A1* | 6/2010 | Grunert | D06F 58/22 210/507 |
| 2011/0167662 | A1 | 7/2011 | Dittmer et al. | |

FOREIGN PATENT DOCUMENTS

| | | | |
|---|---|---|---|
| CN | 1757814 | A | 4/2006 |
| CN | 1786328 | A | 6/2006 |
| CN | 102149866 | A | 8/2011 |
| EP | 0648885 | A1 | 4/1995 |
| EP | 1 669 487 | A1 | 6/2006 |
| JP | 60132282 | U | 9/1985 |
| JP | 10127978 | A | 5/1998 |
| JP | 2004-261324 | | 9/2004 |
| JP | 2006187449 | A | 7/2006 |
| JP | 2009142351 | A | 7/2009 |
| KR | 10-2007-0076853 | A | 7/2007 |
| WO | 2010137910 | A2 | 12/2010 |

* cited by examiner

*Primary Examiner* — Kenneth Rinehart
*Assistant Examiner* — Bao D Nguyen
(74) *Attorney, Agent, or Firm* — Dentons US LLP

(57) ABSTRACT

The present invention relates to a laundry treating machine, and more particularly, a laundry treating machine including an air supply unit for supplying air, a tub for having the air supplied thereto from the air supply unit to treat the laundry, the tub having an air recovery opening formed in an outside circumferential surface thereof for recovery of the air to the air supply unit, a lint filter mounted to an inside of the air recovery opening for filtering the lint from the air, and a filter cleaning unit for spraying cleaning water toward the lint filter to separate the lint from the lint filter, wherein the filter cleaning unit is extended and branched to the inside of the air recovery opening for spraying the cleaning water to the lint filter.

15 Claims, 12 Drawing Sheets

- Prior art -

LAUNDRY TREATING MACHINE

CROSS REFERENCE TO RELATED APPLICATION

This application claims the benefit of the Patent Korean Application No. 10-2012-0017878, filed on Feb. 22, 2012, which is hereby incorporated by reference as if fully set forth herein.

BACKGROUND OF THE DISCLOSURE

1. Field of the Disclosure

The present invention relates to laundry treating machines, and more particularly, to a laundry treating machine which is made to clean a lint filter provided for filtering lint produced when laundry is being dried.

2. Discussion of the Related Art

In general, as examples of the laundry treating machine, there are washing machines, and drying and washing machines. The washing machine is a product for removing different kinds of dirt from clothes and beddings by using a softening action of detergent and a friction and an impact to the laundry of a water circulation caused by a pulsator or a drum. A full automatic washing machine appeared recently progresses a series of strokes of a washing course, a rinsing course, a spinning course, and so on without user's intervention.

And, the drying and washing machine is a kind of the washing machine which can perform functions of the washing machine described above as well as drying the laundry washed thus. In the drying and washing machine, there are condensing type drying and washing machines in which air drawn from the tub has moisture removed therefrom by water used for condensing, and is heated and introduced to the tub, gain.

A related art condensing type drying and washing machine will be described with reference to FIG. 1, briefly. As shown, the drying and washing machine 10 is provided with a cabinet 11 which forms a space therein, a tub 12 housed in cabinet 11, a drum 13 rotatably mounted in the tub 12, a condensing duct 14 formed on an outside of the tub 12 for condensing moisture contained in the air from the tub 12, a heating duct 15 connected to downstream of the condensing duct 14 in a flow direction of the air for heating the air with a heater 16 and providing the air heated thus to an inside of the tub 12, and a fan 17 for making the air in the tub 12 to circulate along the condensing duct 14 and the heating duct 15.

In drying the laundry, the drying and washing machine 10 described thus dries the laundry with rotation of the drum and the air heated as the air is moved by the fan 17, heated by the heater 16 provided to the heating duct 15, and supplied to the inside of the tub 12.

Then, the heated air having the laundry dried thereby is turned to wet air as the heated air dries the laundry, introduced to the condensing duct 14 from the tub 12, and has the moisture removed therefrom at the condensing duct 14. In this case, the condensing duct 14 has cooling water supplied thereto separately for condensing the wet air. In the meantime, the air introduced to the condensing duct 14 is supplied to the heating duct 15 by the fan 17, again. Thus, the air is circulated by repeating above steps.

In order to condense moisture contained in the wet air being introduced to the condensing duct in the steps, it is required to keep supplying a high flow rate of cooling water in the course of drying the laundry, which causes a problem of wasting of the cooling water.

Moreover, in drying the laundry, the lint contained in the laundry is liable to be introduced through the condensing duct 14 together with the air, and remain at the condensing duct 14, the fan 17, and the heating duct 15. Consequently, the lint remaining at the condensing duct 14 is liable to reduce efficiency of the condensing duct, the lint remaining at the condensing duct 14 is liable to make the fan to go out of order, and the lint remaining at the heating duct 15 is liable to make the heater 16 provided to the heating duct 15 to go out of order, or cause breaking out of fire.

SUMMARY OF THE DISCLOSURE

An object of the present invention, devised to solve an above problem, is to provide a laundry treating machine in which a condensing structure which is provided for removing moisture from heated air having laundry dried thereby is improved for improving condensing efficiency.

Another object of the present invention, devised to solve an above problem, is to provide a laundry treating machine which has a lint filter for filtering lint from heated air.

Another object of the present invention, devised to solve an above problem, is to provide a laundry treating machine in which a condensing structure which is provided for removing moisture from heated air having laundry dried thereby is improved for improving condensing efficiency.

And, another object of the present invention, devised to solve an above problem, is to provide a laundry treating machine having an improved repair and maintenance structure of a lint filter which filters lint from heated air.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating machine includes an air supply unit for supplying air, a tub for having the air supplied thereto from the air supply unit to treat the laundry, the tub having an air recovery opening formed in an outside circumferential surface thereof for recovery of the air to the air supply unit, a lint filter mounted to an inside of the air recovery opening extended along an inside circumferential surface of the tub for filtering the lint from the air, and a filter cleaning unit for spraying cleaning water from the inside of the air recovery opening toward an inside of the tub and from an upper side of the lint filter to separate the lint from the lint filter.

It is preferable that the air supply unit is positioned on an upper side of the tub for supplying the air to a front of the tub, and circulating the air through the air recovery opening.

It is preferable that the air supply unit includes a fan positioned over the air recovery opening for moving the air, a heating duct for heating the air being moved by the fan, and an air discharge hole for supplying the air heated at the heating duct to the front of the tub.

It is preferable that the tub has an inside circumferential surface of the tub used as a condensing surface for condensing moisture contained in the air.

It is preferable that the cleaning water sprayed from the filter cleaning unit is used as cooling water for cooling down the condensing surface of the tub.

It is preferable that the filter cleaning unit includes a cleaning water line for supplying the cleaning water, and a distribution nozzle unit for spraying the cleaning water being supplied from the cleaning water line.

It is preferable that the distribution nozzle unit includes a fastening portion connected to the cleaning water line fastened to the air recovery opening detachably, an extension coupled to the fastening portion to extend toward the inside of the air recovery opening, and a nozzle portion branched from the extension for spraying the cleaning water to the lint filter.

It is preferable that the extension is extended to a position having a largest width of the air recovery opening, and the nozzle portion has first and second nozzle portions extended from an end portion of the extension toward width directions of the air recovery opening.

It is preferable that the distribution nozzle unit further includes a bend portion coupled to an end of the extension to be rotatable in a vertical direction of the extension and bent toward the lint filter, and a rotatable distribution portion coupled to the bend portion to be rotatable in a horizontal direction of the bend portion for having the first and second nozzle portions coupled thereto to branch and supply the cleaning water.

It is preferable that the first and second nozzle portions include a plurality of nozzles for spraying the cleaning water to a tangential direction of the lint filter.

It is preferable that the extension is extended to the other side of the air recovery opening, and the nozzle portion includes one pair of nozzle portions extended from the end of the extension to curve along a curved surface of the inside circumferential surface of the air recovery opening.

It is preferable that the one pair of nozzle portions are extended to tilt along a slope of the lint filter.

It is preferable that the one pair of nozzle portions include a plurality of nozzles for spraying the cleaning water in a tangential direction of the lint filter.

It is preferable that the extension is extended to the other side of the air recovery opening, and the nozzle portion includes one pair of nozzle portions extended perpendicular to the extension from the end of the extension.

It is preferable that the one pair of nozzle portions include a plurality of nozzles for spraying the cleaning water to a tangential direction of the lint filter.

It is preferable that the one pair of nozzle portions include a plurality of nozzles for spraying the cleaning water at a slant to widen spread of the cleaning water in a width direction of the lint filter.

It is preferable that the lint filter includes a filter frame formed in conformity with an inside shape of the air recovery opening to form a space for flow of the air, and a filter provided to the space in the filter frame for filtering the lint.

It is preferable that the filter frame includes a reflective plate for shielding a portion of the filter for preventing the cleaning water sprayed from the filter cleaning unit from introducing to the inside of the tub.

It is preferable that the filter frame further includes at least a guide rib extended along the curved slope of the filter.

It is preferable that the filter cleaning unit is formed passed through the air recovery opening to position at one side of the air recovery opening.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

In describing the present invention, terms of elements defined herein have been defined taking functions thereof in the present invention into account. Therefore, it is required that the terms are not to be understood in a sense that the terms limit technical elements of the present invention. And, the terms of the elements defined thus may be called in other terms in this field of art.

A laundry treating machine in accordance with a preferred embodiment of the present invention will be described with reference to the attached drawings, in detail.

Figure 1:
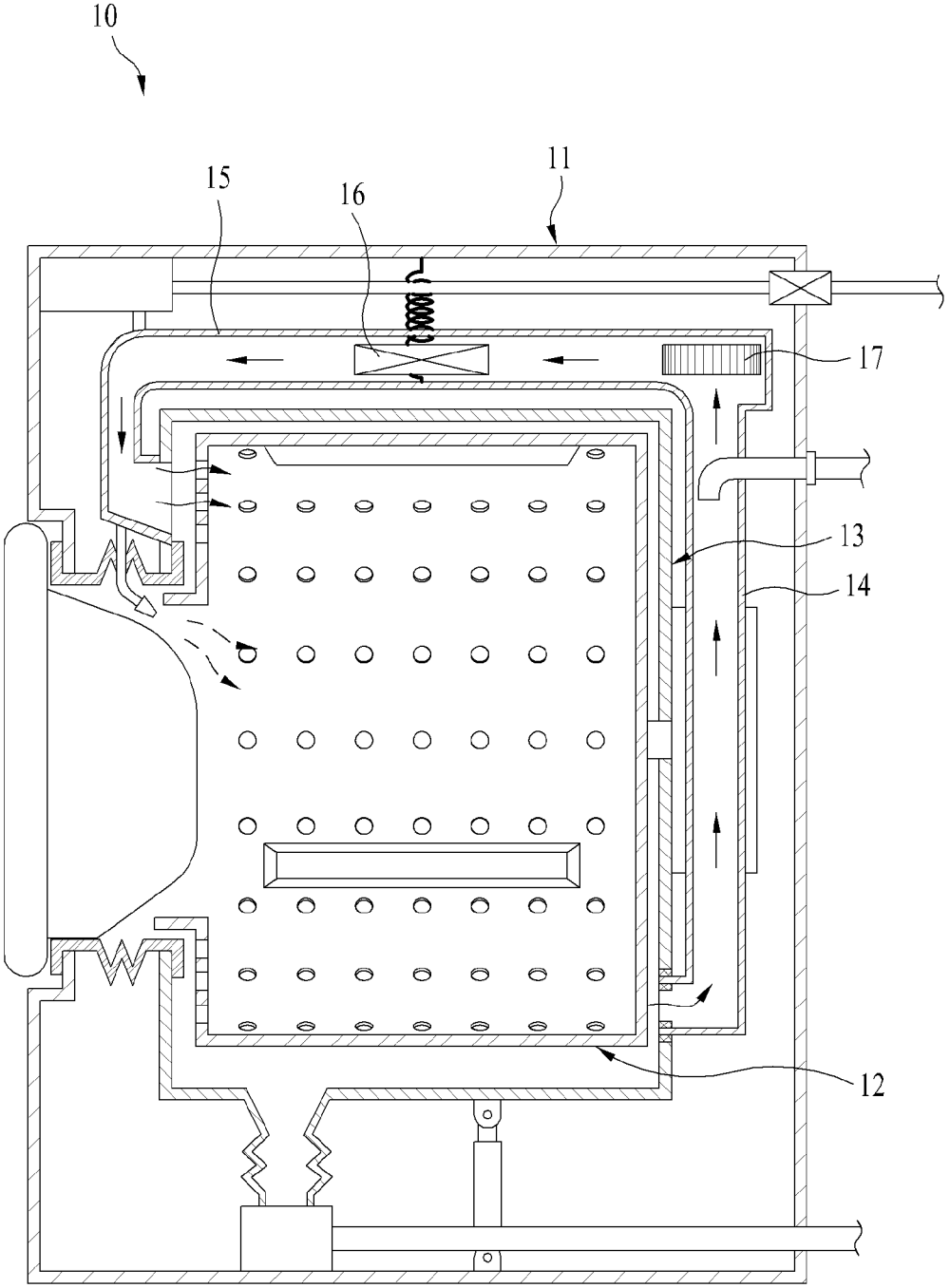
FIG. 1 illustrates a longitudinal section of a related art condensing type drying and laundry treating machine.
Figure 2:
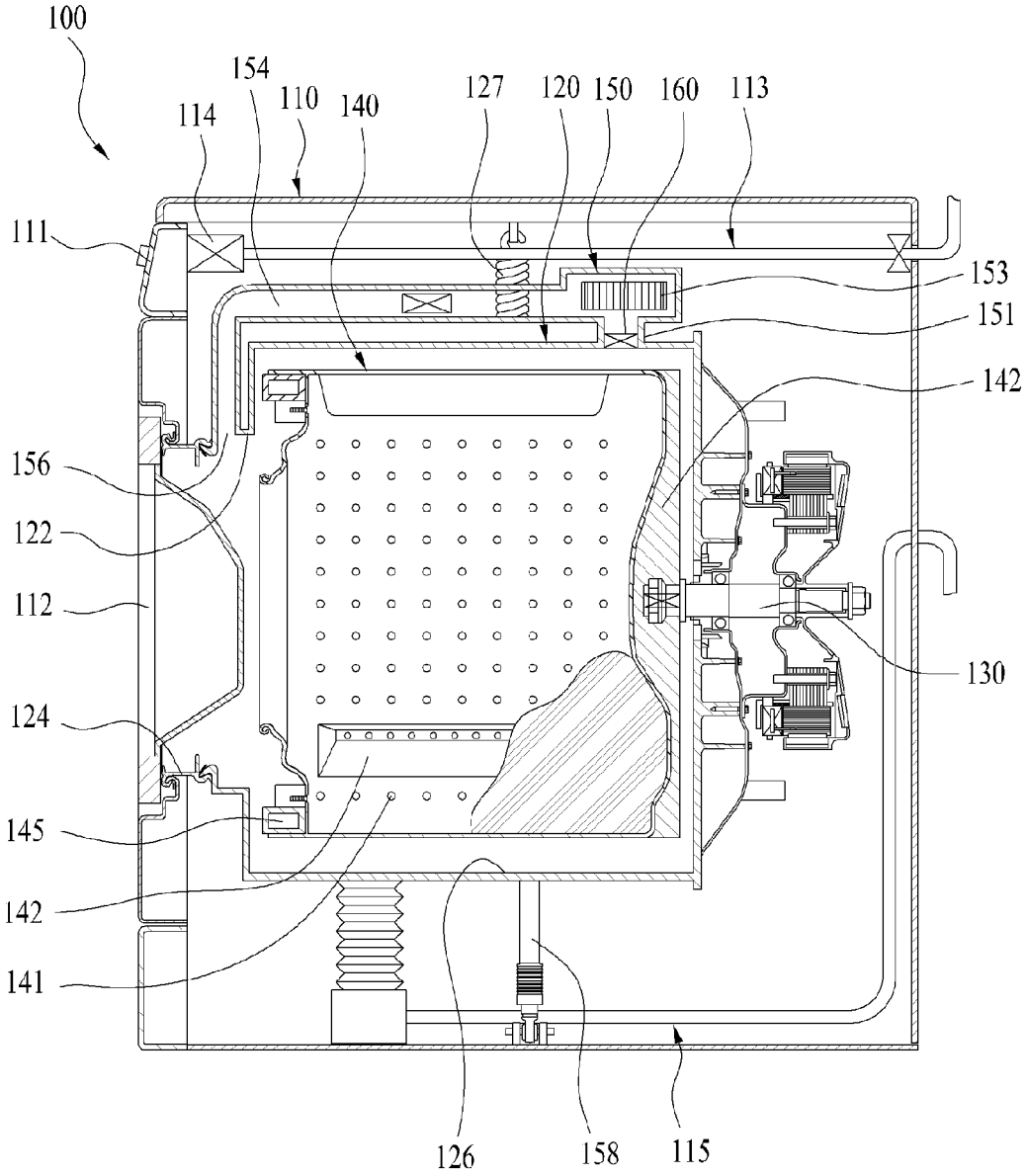
FIG. 2 illustrates a schematic view of an inside structure of a laundry treating machine of the present invention.
Figure 3:
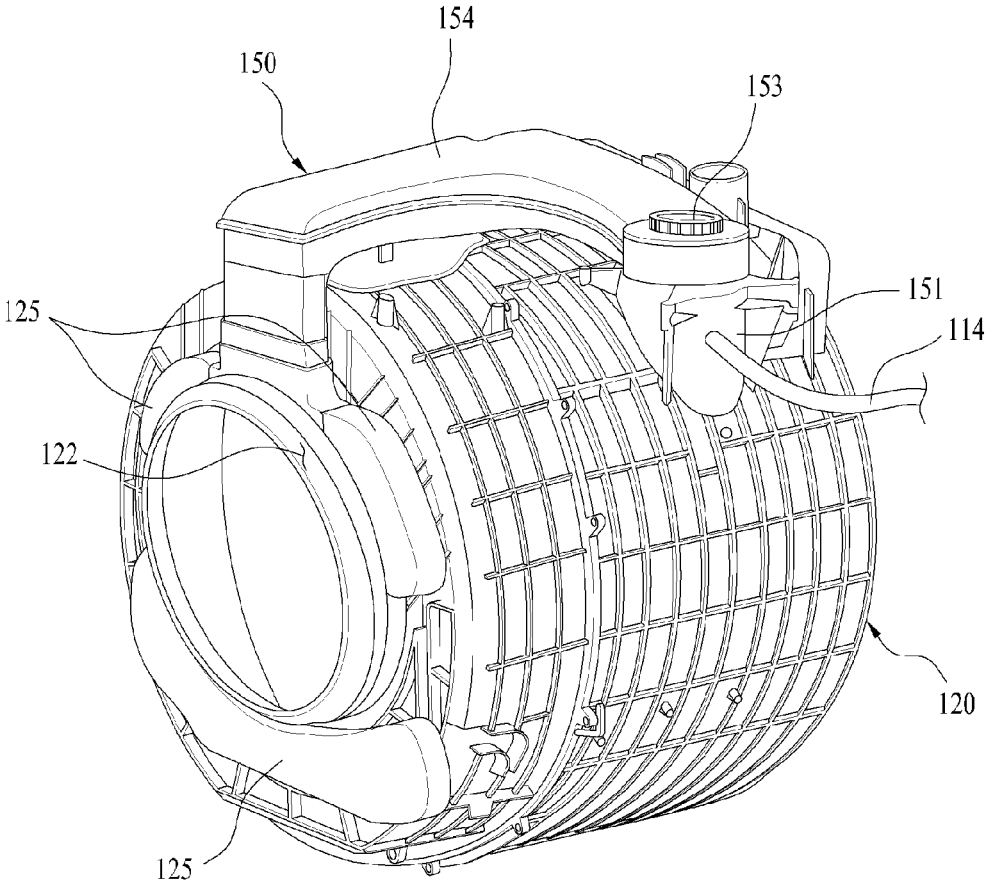
FIG. 3 illustrates a perspective view showing key parts of a laundry treating machine of the present invention.

FIG. 2 illustrates a schematic view of an inside structure of a laundry treating machine of the present invention, and FIG. 3 illustrates a perspective view showing key parts of a laundry treating machine of the present invention.

Referring to FIGS. 2 and 3, the laundry treating machine includes a cabinet 110 which forms an exterior appearance of the laundry treating machine, a tub 120 provided in the cabinet 110 for holding washing water, a drum 140 provided in the tub 120 to be rotatable in an axis direction, a driving motor 130 for giving rotating force to the drum 140 to wash, rinse, or spin laundry introduced to the drum 140, an air supply unit 150 for supplying heated air to the tub 120 to dry the laundry 1, a control unit (Not shown) for controlling respective elements to operate the laundry treating machine 100, and an operation panel 111 for controlling respective elements in association with the control unit.

The cabinet 110 forms an exterior appearance of the laundry treating machine 100 of the embodiment, and has various elements to be described later mounted to an outside or an inside thereof. The cabinet 110 has a door 112 rotatably mounted to a front thereof.

And, provided to an upper side of an inside of the cabinet 110, there is a water supply unit 113 including a water supply hose for supplying water to an inside of the tub 120 from an external water source, a water supply valve mounted to the water supply hose for controlling water supply, and a detergent supply unit 114 for introducing detergent thereto such that the water supplied through the water supply hose is introduced to the inside of the tub 120 together with the detergent.

And, provided to a lower side of the inside of the cabinet 110, there is a drain unit 115 having a drain hose and a drain pump for draining the washing water used for washing and rinsing to an outside of the laundry treating machine.

The tub 120 is provided in the cabinet 110 to hold the washing water, and has a shape of a container opened toward a door 112 side for receiving the laundry 1 introduced through the door 112.

In this case, the tub 120 has an opened portion formed in a front thereof for introducing the laundry 1 thereto. There is a weight 125 attached to an outside of the opened portion for increasing a weight of the tub 120 to prevent vibration from taking place. And, the opened portion has a rim portion 122 projected from an inside circumference thereof toward a front of the tub 120. The rim portion 122 has an air discharge hole 156 of the air supply unit 150 to be described later connected thereto. In the meantime, the tub 120 has an air recovery opening 151 of the air supply unit 150 to be described later formed in an outside circumference thereof.

And, mounted to a rear of the tub 120, there is a driving motor 130 for rotating the drum 140. The control unit controls a rotation speed of the driving motor 130. Since structures and kinds of the driving motor 130 are known to persons in this field of art, and may have many variations, detailed description thereof will be omitted.

The laundry treating machine 100 of the present invention has an inside circumferential surface of the tub 120 formed to be used as a condensing surface 126 for forming condensed water. According to this, a structure of a condensing duct in the related art for condensing the moisture in wet air having the laundry 1 dried thereby is omitted. A process for producing the condensing water changed according to the omission of the condensing duct will be described in description of the air supply unit 150 and in description of operation of the laundry treating machine 100, in detail.

In the meantime, the tub 120 is supported by springs 17 on the upper side and dampers 128 on a lower side thereof, elastically. According to this, the springs 127 and the dampers 128 attenuate vibration generated when the drum is rotated by the driving motor 130 and transmitted through the tub 120, thereby reducing transmission of the vibration caused by the rotation of the drum 140.

The drum 140 is rotatably provided to an inside of the tub 120, and the laundry 1 introduced through the door 112 is held in the drum 140. The drum 140 has a plurality of water extraction holes 141 formed therein for passing through of the washing water, and a plurality of lifts 142 formed on an inside of the drum 140 for loading the laundry 1 thereon, lifting, and dropping the laundry 1 in the drum 140 when the drum 140 rotates, to improve a washing performance.

And, mounted on a front and a rear of the drum 140, there are balancers 145 to compensate for unbalance caused by the laundry 1 when the drum 140 rotates. Provided in rear of the drum 140, there are a rotation shaft 144 connected to the driving motor 130, and a spider 143 connected to the rotation shaft 144.

The air supply unit 150 is provided to the upper side of the tub 120 for circulating and heating the air in the tub 120 in the drying stroke. That is, the air supply unit 150 is configured to draw the air from the inside of the tub 120, heat the air, and introduce to the tub 120, again.

The air supply unit 150 includes an air recovery opening 151 formed in a side of an outside circumferential surface of the tub 120, a fan 153 for recovery of the air through the air recovery opening 151 and making the air to move, a heating duct 154 for heating the air being moved by the fan 153, and an air discharge hole 156 for guiding the air heated at the heating duct 154 to the tub 120.

In this case, the air recovery opening 151 is formed to pass through the side of the outside circumferential surface of the tub 120. And, the air recovery opening 151 has a lint filter 160 provided to an inside surface thereof along the outside circumferential surface of the tub 120 for filtering the lint produced when the laundry 1 is dried.

In this case, the lint filter 160 is provided to an inside of the air recovery opening 151 to be inserted therein, detachably. For this, the lint filter 160 has a filter frame 161 having a space for flow of the air therethrough formed in conformity with an inside shape of the air recovery opening 151, and a filter 162 provided to the air flow space of the filter frame 161 for filtering the lint. In this case, it is preferable that the filter 162 has a predetermined curve so as to be extended along a curved shape of an inside circumference of the tub 120.

In the meantime, the filter 162 may have at least one guide rib 161*a* formed at middle of the filter extended along a curved surface of the filter 162, additionally. In this case, the guide rib 161*a* serves to maintain a shape of the filter 162 and guide the cleaning water sprayed to the filter 162 to be able to flow down along the curved surface, smoothly. That is, the cleaning water is collected at a corner between the guide rib 161*a* and the filter 162 the guide rib 161*a* is formed, and the cleaning water collected thus flows down along the corner between the filter 162 and the guide rib 161 toward a lower side of the curved surface of the filter 162 by gravity (See FIG. 5).

In the meantime, provided over the lint filter 160 in the air recovery opening 151, there is a filter cleaning unit 170 for removing the lint filtered at the lint filter 160. The filter cleaning unit 170 will be described later with reference to different embodiments, in detail.

And, the fan 153 is provided over the air recovery opening 151. As the fan 153 operates, the air is drawn from the inside of the tub 120 and discharged toward the heating duct 154. In the meantime, the heating duct 154 heats the air being moved by the fan 153 to produce heated air. The air heated in the heating duct 154 is supplied to the inside of the tub 120 through the air discharge hole 156, to dry the laundry 1.

In the meantime, in the air supply unit 150 described thus, the lint filter 160 that filters lint from the air introduced to the air recovery opening 151 requires maintenance for removing the lint filtered thus when the lint filter 160 is used for a long time period.

For this, provided to the inside of the air recovery opening 151, there is a filter cleaning unit 170 for removing the lint filtered at the lint filter 160 by spraying cleaning water toward the lint filter 160. In this case, the filter cleaning unit 170 has water supply thereto controlled by a separate cleaning water valve (Not shown) at the water supply unit 113 which supplies washing water for washing the laundry.

In the meantime, in the filter cleaning unit 170 described above, the cleaning water sprayed to the lint filter 160 for cleaning the filter serves, not only separating/removing the lint filtered from the lint filter 160, but also flows down along an inside circumferential surface of the lint filter 160, and, therefrom, to an inside circumferential surface (i.e., a condensing surface) of the tub 120 to cool down the inside circumferential surface of the tub 120.

In this case, as the inside circumferential surface of the tub 120 is cooled down by the filter cleaning water, the moisture contained in the air having the laundry dried thereby in the tub 120 is condensed as the moisture comes into contact with the inside surface of the tub 120, to turn the air into relatively dry air.

In the meantime, the tub 120 of the present invention has high temperature and humid air staying therein, and air with a temperature lower than the inside of the tub 120 staying on an outside thereof. Therefore, even if no cleaning water is supplied from the filter cleaning unit 170 as described before, the condensing at the inside circumferential surface of the tub 120 can take place owing to a temperature difference between the inside and outside temperatures of the tub 120. Even in this case too, a condensing rate of the present invention can be larger than a condensing rate with the condensing duct in the related art.

That is, the condensing duct in the related art induces the condensing with an area smaller than the inside circumferential surface of the tub 120. However, if the condensing is induced by the inside circumferential surface of the tub 120 like the present invention, an area of cooling for the condensing increases larger than the condensing duct, relatively. Therefore, since the laundry treating machine of the present invention has a larger condensing surface 126 than the related art which uses the condensing duct, condensing efficiency can be increased.

In the meantime, the filter cleaning unit 170 in accordance with a preferred embodiment of the present invention is provided for spraying the cleaning water at a predetermined pressure in a direction from the outside to the inside of the lint filter 160 to drop the lint to the inside of the tub 120 from the lint filter 160. And, as described before, it is also possible to induce that the condensed water having the lint removed thereby as described before is made to flow the inside circumferential surface of the tub 120 to cool down the inside circumferential surface of the tub 120.

The filter cleaning unit 170 includes a cleaning water line 171 for supplying the cleaning water, and a distribution nozzle unit secured to the inside of the air recovery opening 151 passed through the air recovery opening 151 and connected to the cleaning water line 171 on an outside of the air recovery opening 151.

In this case, it is preferable that the filter cleaning unit 170 is mounted to an outer side (Or, an outer side of the tub 120) of the air recovery opening 151. That is, in a case the air recovery opening 151 is formed perpendicular to an outside circumferential surface of the tub 120 to form such that a height/an area of a surface facing a center of the tub 120 are respectively different from a height/an area of a surface facing an outer side of the tub 120, leading the height/the area of the surface facing the center of the tub 120 are respectively larger than the height/the area of the surface facing an outer side of the tub 120. Therefore, it is preferable that the filter cleaning unit 170 is mounted to the outer side of the air recovery opening 151 (Or, the outer side of the tub 120). However, the embodiment does not limit a position of the filter cleaning unit 170, but the filter cleaning unit 170 may be mounted to any surface of the air recovery opening 151 as far as a mounting space can be secured at the air recovery opening 151.

In the meantime, the specification of the present invention intends to provide three embodiments on the distribution nozzle unit of the filter cleaning unit. An air recovery opening and a filter cleaning unit will be described for each of the embodiments of the distribution nozzle with reference to the attached drawings, in detail.

An air recovery opening and a filter cleaning unit in accordance with a first preferred embodiment will be described. It is required to understand elements described herein, with reference to the foregoing description and drawings. And, detailed description of parts repetitive with the foregoing description will be omitted.

Figure 4:
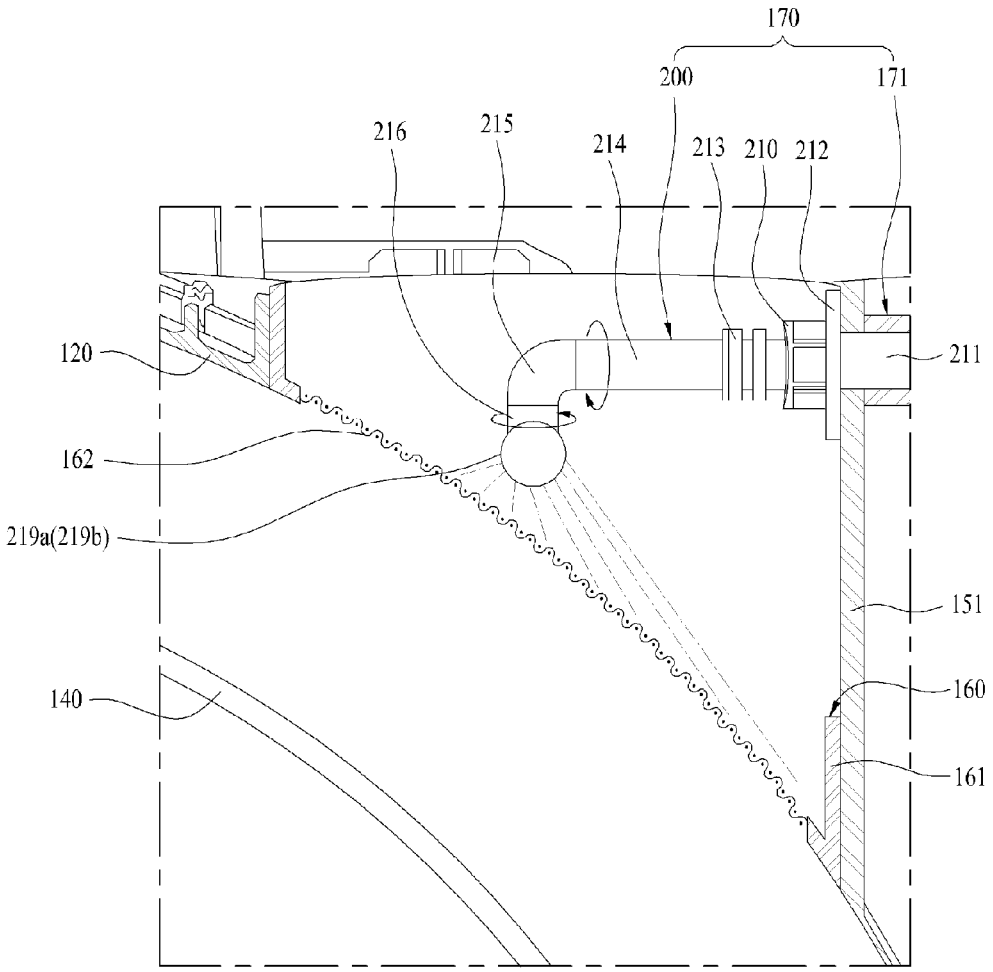
FIG. 4 illustrates a transverse section showing an air recovery opening and a filter cleaning unit in accordance with a first preferred embodiment of the present invention.
Figure 5:
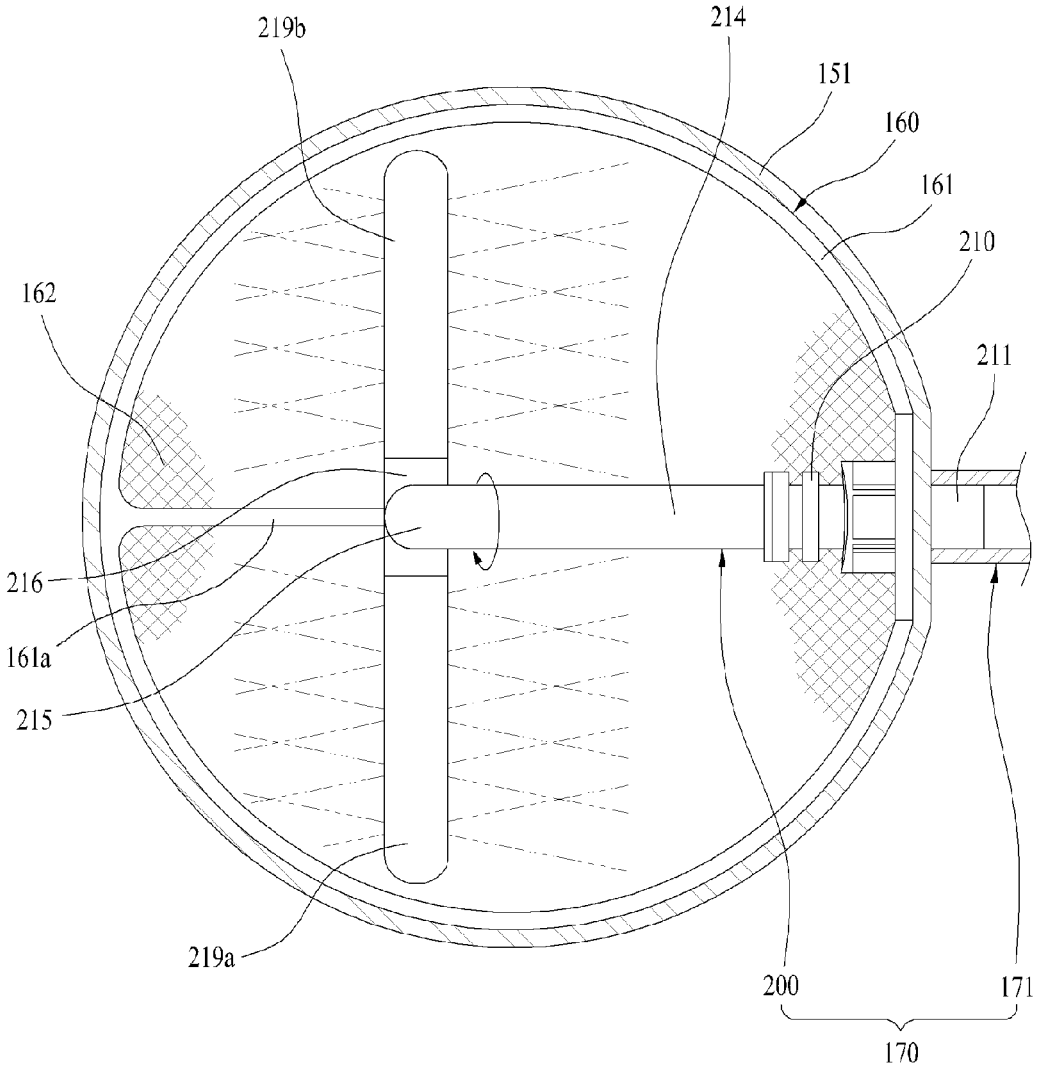
FIG. 5 illustrates a plan view of an air recovery opening and a filter cleaning unit in accordance with a first preferred embodiment of the present invention.

FIG. 4 illustrates a transverse section showing an air recovery opening and a filter cleaning unit in accordance with a first preferred embodiment of the present invention, and FIG. 5 illustrates a plan view of an air recovery opening and a filter cleaning unit in accordance with a first preferred embodiment of the present invention.

Referring to FIGS. 4 and 5, the filter cleaning unit includes a lint filter 160 provided to an inside of the air recovery opening 151 provided to an outside circumferential surface of the tub 120 for filtering the lint produced when heated air is supplied and circulated for drying the laundry, and a filter cleaning unit 170 for cleaning the lint filter 160.

The filter cleaning unit 170 in accordance with a preferred embodiment of the present invention is provided for spraying the cleaning water in a direction from the outside to the inside of the lint filter 160 to drop the lint to the inside of the tub 120 from the lint filter 160.

In the meantime, the filter cleaning unit 170 includes a cleaning water line 171 for supplying the cleaning water, and a distribution nozzle unit 200 for distributing the cleaning water being supplied from the cleaning water line 171 and spraying the cleaning water to the lint filter 160.

In this case, the cleaning water line 171 is configured to supply the cleaning water separate from the washing water supply with a cleaning water valve (Not shown) provided separate from the washing water supply of the water supply unit 113. Since the configuration of the cleaning water line 171 may have numerous variations, detailed description thereof will be omitted.

The distribution nozzle unit 200 is provided to be secured to the inside of the air recovery opening 151 connected to the cleaning water line 171 for having the cleaning water supplied thereto through the cleaning water line 171 and spraying the cleaning water to an upper side of the filter of the lint filter 160.

The distribution nozzle unit 200 includes a fastening portion 210 for fastening to the air recovery opening 151 detachably, an extension 214 coupled to the fastening portion 210 to extend toward the inside of the air recovery opening 151, a bend portion 215 rotatably coupled to an end of the extension 214 for bending a direction of the cleaning water supplied through the extension 214 toward the lint filter 160, a rotatable distribution portion 216 rotatably coupled to the end of the bend portion 215 for distributing the cleaning water being supplied through the bend portion 215, and first, and second nozzle portions 219*a* and 219*b* respectively fastened to both ends of the rotatable distribution portion 216 for spraying the cleaning water being supplied through the rotatable distribution portion 216 to the upper side of the filter 162 of the lint filter 160. In this case, the fastening portion 210, the extension 214, the bend portion 215, the rotatable distribution portion 216, and the first, and second nozzle portions 219*a* and 219*b* are hollow for pass of the cleaning water therethrough.

In the meantime, the air recovery opening 151 has one side having a fastening hole (Not shown) or a fastening recess (Not shown) formed therein for having the fastening portion of the distribution nozzle unit 200 coupled thereto. In this case, the fastening hole or the fastening recess may be a holding step or a thread for securing the fastening portion of the distribution nozzle unit 200 thereto. Since a fastening structure of the fastening hole or the fastening recess may have numerous variations, detailed description thereof will be omitted.

In this case, the fastening portion 210 is detachably mounted to one side of the air recovery opening 151. The fastening portion 210 is hollow cylinder for pass of the cleaning water therethrough. The fastening portion 210 has one end with a line fastening portion 211 formed thereon for connection to the cleaning water line 171. The fastening portion 210 has the other end with a connection step 213 for having the extension 214 connected thereto. Formed along the circumferential surface between the line fastening portion 211 and the extension 214, there is a securing rib 212 for securing the fastening portion 210 with respect to the air recovery opening 151.

The extension 214 has a hollow tube shape coupled to the connection step 213 of the fastening portion 210 to form a passage for moving the cleaning water. The extension 214 is coupled to the connection step 213 and extended toward the center of the lint filter 160. It is preferable that the extension 214 is extended beyond the center which has a largest width of the lint filter 160.

And, the bend portion 215 has a hollow bent downward toward the lint filter. The bend portion 215 is rotatably coupled to the extension for enabling adjustment of an angle of the bend portion 215 as the bend portion 215 is rotated. That is, the bend portion 215 is rotatably provided to have a vertical direction rotation radius taking the extension 214 as a rotation shaft.

And, the rotatable distribution portion 216 has a hollow inverted "T" shape. The rotatable distribution portion 216 has an inlet hole at a center thereof rotatably coupled to the bend portion 215, and one pair of outlet holes formed in opposite directions on both sides of the inlet hole coupled to the first and second nozzle portions 219*a* and 219*b*. In the meantime, the rotatable distribution portion 216 is provided to be rotatable to have a horizontal direction rotation radius taking a downward bent portion of the bend portion 215 as a rotation shaft.

And, the first, and second nozzle portions 219*a* and 219*b* are hollow cylinders fastened to the opposite outlet holes in the rotatable distribution portion 216, respectively. Each of the first, and second nozzle portions 219*a* and 219*b* has one opened side and the other closed side.

Figure 6A:
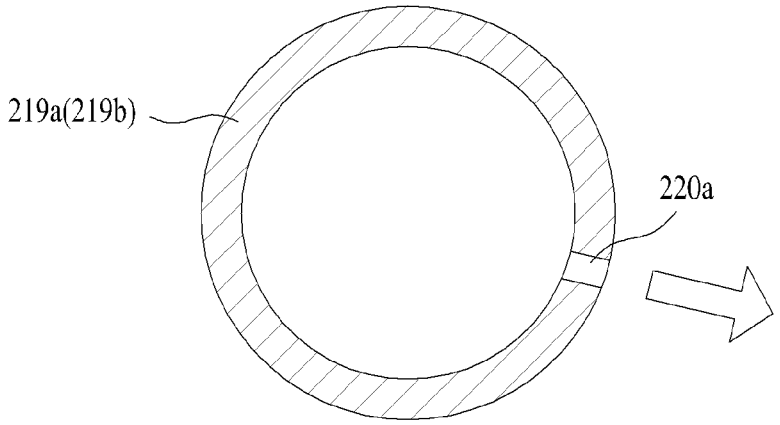
FIGS. 6A and 6B illustrate sections each showing a key portion of the nozzle portion in FIG. 5 of the present invention.

In the meantime, the first, and second nozzle portions 219*a* and 219*b* have a plurality of first nozzles 220*a* for spraying the cleaning water toward an upper surface of the filter 162 of the lint filter 160 in a tangential direction of the surface (See FIG. 6A).

In this case, the cleaning water from the first nozzles 220*a* is sprayed to a fixed area of the filter 162 owing to an angle of the spray from the first nozzles 220*a* and a curve and a slope of the filter 162 of the lint filter 160, thereby separating and removing the lint from the filter 162.

Figure 6B:
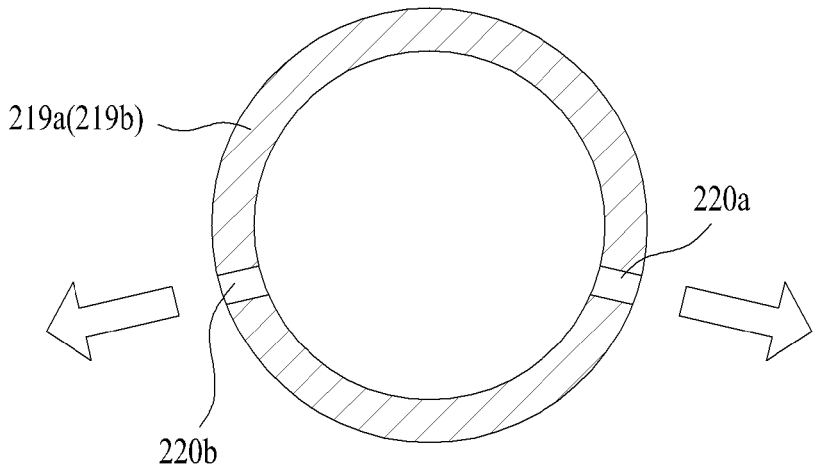

In the meantime, the first, and second nozzle portions 219*a* and 219*b* may have second nozzles 220*b* additionally for spraying the cleaning water in a direction different from the first nozzles 220*a* to spray the cleaning water to an area the cleaning water sprayed from the first nozzles 220*a* can not reach thereto (For an example, an area opposite to the area sprayed by the first nozzles 220*a*). (See FIG. 6B).

In this case, alike the first nozzles, the cleaning water from the second nozzles 220*b* is sprayed to a fixed area of the filter 162 owing to an angle of the spray from the second nozzles 220*b* and the curve and the slope of the filter 162 of the lint filter 160, thereby separating and removing the lint from the filter 162.

The operation of the filter cleaning unit 170 in accordance with the first preferred embodiment of the present invention will be described.

In a case of the laundry treating machine 100 of the present invention, the filter cleaning unit 170 may be operated for cleaning the lint filter 160 during the washing stroke, the spinning stroke, or the drying stroke. However, it is preferable that the filter cleaning unit 170 is operated in the drying stroke when most of the lint is filtered at the lint filter 160.

In the meantime, the operation process of the filter cleaning unit 170 is as follows. If the cleaning of the lint filter 160 is performed by the filter cleaning unit 170, the cleaning water is supplied through the cleaning water line 171 for cleaning the lint filter 160, and the cleaning water is distributed and supplied to the first, and second nozzle portions 219*a* and 219*b* through the hollows in the fastening portion 210, the extension 214, the bend portion 215, and the rotatable distribution portion 216. The cleaning water supplied to the first, and second nozzle portions 219*a* and 219*b* is sprayed through the first nozzles 220*a* and/or the second nozzles 220*b* formed in the first, and second nozzle portions 219*a* and 219*b*, to clean the lint filter 160.

In this case, the first, and second nozzle portions 219*a* and 219*b* may have a spray angle thereof adjusted with vertical direction rotation of the bend portion 215 coupled to the extension 214, and horizontal direction rotation of the rotatable distribution portion 216 coupled to the bend portion 215.

The distribution nozzle unit 200 of the filter cleaning unit 170 is provided to spray the cleaning water downward from the upper side of the lint filter 160 formed in a sloped curve. Accordingly, the cleaning water sprayed toward the upper side of the lint filter 160 is able to flow down to a lower side of the lint filter 160 smoothly owing to the curved slope of the lint filter 160. That is, since the lint filter 160 is mounted to have one high side with a predetermined curve, the cleaning water sprayed by the distribution nozzle 200 from the upper side of the lint filter 160 is collected at the filter 162 of the lint filter 160, and flows downward along the curved slope of the filter 162 to the lower side of the lint filter 160.

In the meantime, the cleaning water, sprayed to the lint filter 160 to clean and separate the lint from the lint filter 160, flows down along the inside circumferential surface of the tub 120 together with the lint separated thus and drained to an outside of the laundry treating machine 100 through the drain unit 115 formed under the tub 120.

In this case, the cleaning water flowing down along the inside circumferential surface of the tub 120 is drained while cooling down the inside surface of the tub 120. Eventually, by cooling the inside surface of the tub 120, the cleaning water makes the inside surface of the tub 120 to serve as the condensing surface 126.

An air recovery opening and a filter cleaning unit in accordance with a second preferred embodiment will be described. It is required to understand elements described herein, with reference to the foregoing description and drawings. And, detailed description of parts repetitive with the foregoing description may be omitted.

Figure 7:
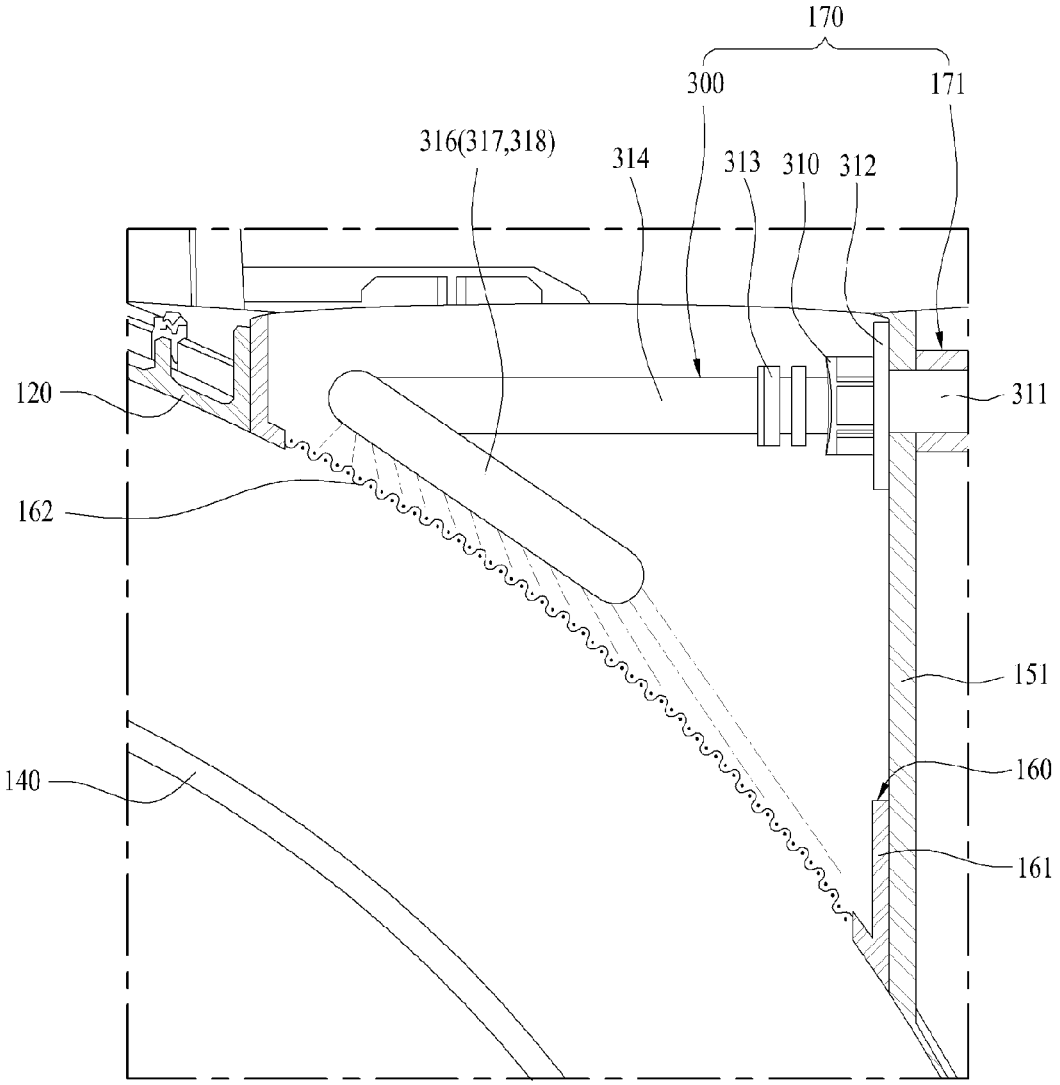
FIG. 7 illustrates a transverse section showing an air recovery opening and a filter cleaning unit in accordance with a second preferred embodiment of the present invention.
Figure 8:
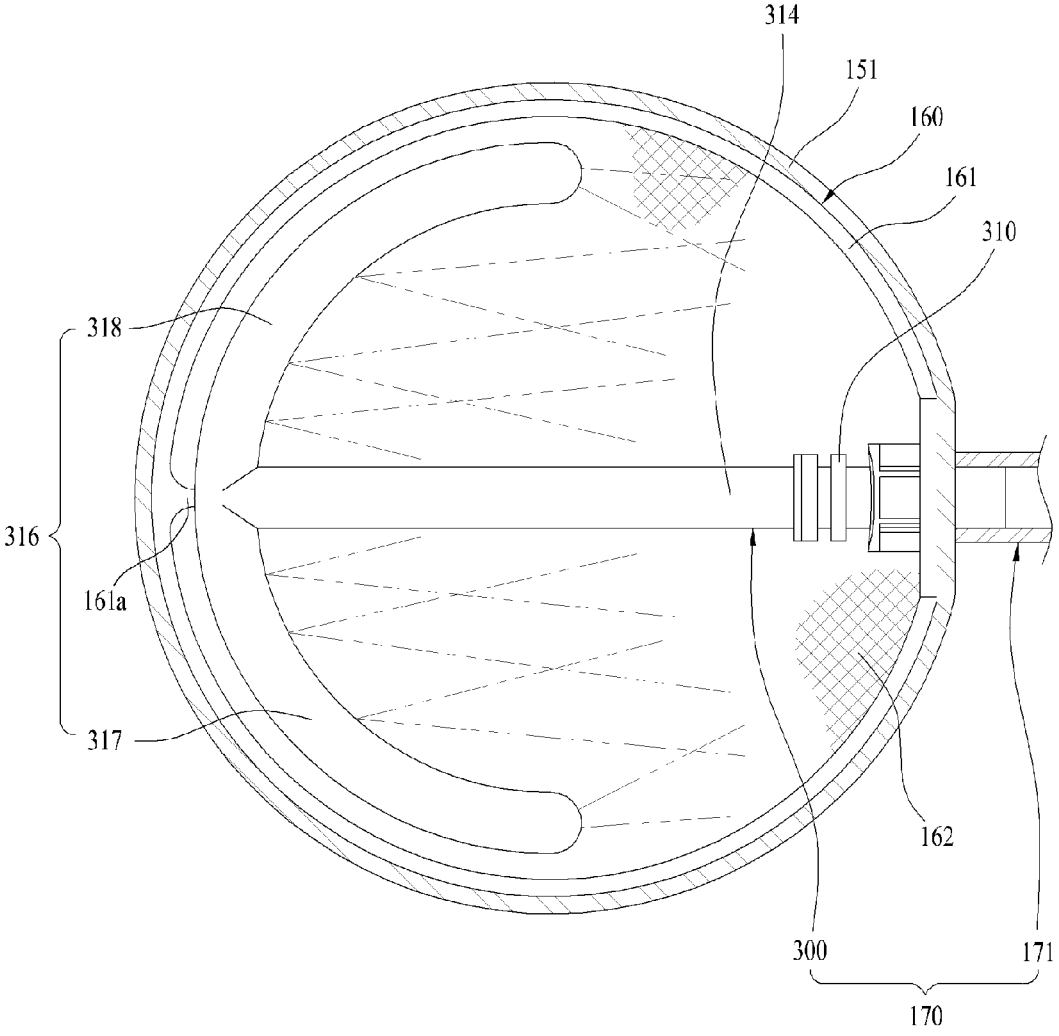
FIG. 8 illustrates a plan view of an air recovery opening and a filter cleaning unit in accordance with a second preferred embodiment of the present invention.

FIG. 7 illustrates a transverse section showing an air recovery opening and a filter cleaning unit in accordance with a second preferred embodiment of the present invention, and FIG. 8 illustrates a plan view of an air recovery opening and a filter cleaning unit in accordance with a second preferred embodiment of the present invention.

Referring to FIGS. 7 and 8, the filter cleaning unit includes a lint filter 160 provided to an inside of the air recovery opening 151 provided to an outside circumferential surface of the tub 120 for filtering the lint produced when heated air is supplied and circulated for drying the laundry, and a filter cleaning unit 170 for cleaning the lint filter 160.

The filter cleaning unit 170 in accordance with a preferred embodiment of the present invention is provided for spraying the cleaning water in a direction from the outside to the inside of the lint filter 160 to drop the lint to the inside of the tub 120 from the lint filter 160.

In the meantime, the filter cleaning unit 170 includes a cleaning water line 171 for supplying the cleaning water, and a distribution nozzle unit 300 for distributing the cleaning water being supplied from the cleaning water line 171 and spraying the cleaning water to the lint filter 160.

In this case, the cleaning water line 171 is configured to supply the cleaning water separate from the washing water supply with a cleaning water valve (Not shown) provided separate from the washing water supply of the water supply unit 113. Since the configuration of the cleaning water line 171 may have numerous variations, detailed description thereof will be omitted.

The distribution nozzle unit 300 is provided to be secured to the inside of the air recovery opening 151 and connected to the cleaning water line 171 for having the cleaning water supplied thereto through the cleaning water line 171 and spraying the cleaning water to an upper side of the filter of the lint filter 160.

The distribution nozzle unit 300 includes a fastening portion 310 for fastening to the air recovery opening 151 detachably, an extension 314 coupled to the fastening portion 310 extended toward the inside of the air recovery opening 151, and a tilted nozzle portion 316 in communication with an end portion of the extension extended curved along the inside circumferential surface of the lint filter 160 for spraying the cleaning water to the filter. In this case, the fastening portion 310, the extension 314, and the tilted nozzle portion 316 are hollow for pass of the cleaning water therethrough.

In the meantime, the air recovery opening 151 has one side having a fastening hole (Not shown) or a fastening recess (Not shown) formed therein for having the fastening portion of the distribution nozzle unit 300 coupled thereto. In this case, the fastening hole or the fastening recess may be a holding step or a thread for securing the fastening portion of the distribution nozzle unit 300 thereto. Since a fastening structure of the fastening hole or the fastening recess may have numerous variations, detailed description thereof will be omitted.

In this case, the fastening portion 310 is detachably mounted to one side of the air recovery opening 151. The fastening portion 310 is hollow cylinder for pass of the cleaning water therethrough. The fastening portion 310 has one end with a line fastening portion 311 for connection to the cleaning water line 171 formed thereon.

In the meantime, the fastening portion 310 has the other end with a connection step 313 for having the extension 314 connected thereto. Formed along the circumferential surface between the line fastening portion 311 and the extension 314, there is a securing rib 312 for securing the fastening portion 310 with respect to the air recovery opening 151 when the fastening portion 310 is coupled to the air recovery opening 151.

The extension 314 has a hollow tube shape coupled to the connection step 313 of the fastening portion 310 to form a passage of the cleaning water being supplied through the fastening portion 310. The extension 314 is coupled to the connection step 313 and extended close to an opposite side of the lint filter 160.

And, the tilted nozzle portion 316 includes one pair of first and second tilted portions 317 and 318 which are curved and tilted extensions along an upper side of an outside circumferential surface of the lint filter 160. In this case, the first and second tilted portions 317 and 318 have a plurality of nozzles (Not shown) for spraying the cleaning water to a lower side or an inside direction of the filter from the upper side of the outside circumferential surface of the lint filer 160.

In this case, the cleaning water from the nozzles is sprayed to a fixed area of the filter 162 owing to an angle of the spray from the nozzles and the curve and the slope of the filter 162 of the lint filter 160, thereby separating and removing the lint from the filter 162.

The operation of the filter cleaning unit 170 in accordance with the second preferred embodiment of the present invention will be described.

In a case of the laundry treating machine 100 of the present invention, the filter cleaning unit 170 may be operated for cleaning the lint filter 160 during the washing stroke, the spinning stroke, or the drying stroke. However, it is preferable that the filter cleaning unit 170 is operated in the drying stroke when most of the lint is filtered at the lint filter 160.

In the meantime, the operation process of the filter cleaning unit 170 is as follows. If the cleaning of the lint filter 160 is performed by the filter cleaning unit 170, the cleaning water is supplied through the cleaning water line 171 for cleaning the lint filter 160, and the cleaning water is distributed to the first and second tilted portions 317 and 318 through the hollows in the fastening portion 310, the extension 314, and the tilted nozzle portion 316. The cleaning water supplied to the first and second tilted portions 317 and 318 is sprayed through nozzles formed in the first and second tilted portions 317 and 318, to clean the lint filter 160.

The distribution nozzle unit 300 of the filter cleaning unit 170 is provided to spray the cleaning water downward from the upper side of the lint filter 160 formed in a sloped curve. Accordingly, the cleaning water sprayed toward the upper side of the lint filter 160 is able to flow down to a lower side of the lint filter 160 smoothly owing to the sloped curve of the lint filter 160. That is, since the lint filter 160 is mounted to have one high side with a predetermined curve, the cleaning water sprayed by the distribution nozzle 300 from the upper side of the lint filter 160 is collected at the filter 162 of the lint filter 160, and able to flow downward along the curved slope of the filter 162 to the lower side of the lint filter 160 by gravity.

In the meantime, the cleaning water, sprayed to the lint filter 160 to clean and separate the lint from the lint filter 160, flows down along the inside circumferential surface of the tub 120 together with the lint separated thus and drained to an outside of the laundry treating machine 100 through the drain unit 115 formed under the tub 120.

In this case, the cleaning water flowing down along the inside circumferential surface of the tub 120 is drained while cooling down the inside surface of the tub 120. Eventually, by cooling the inside surface of the tub 120, the cleaning water makes the inside surface of the tub 120 to serve as the condensing surface 126.

An air recovery opening and a filter cleaning unit in accordance with a third preferred embodiment will be described. It is required to understand elements described herein, with reference to the foregoing description and drawings. And, detailed description of parts repetitive with the foregoing description may be omitted.

Figure 9:
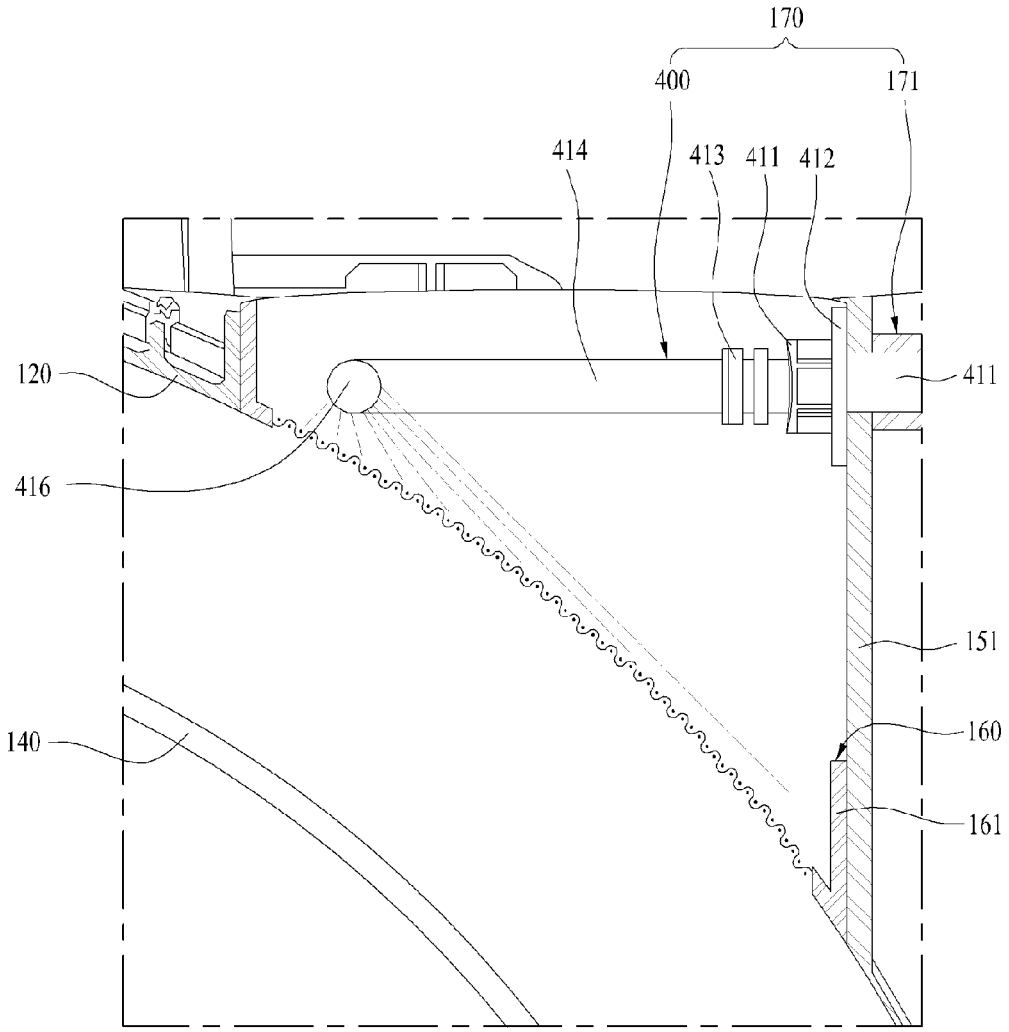
FIG. 9 illustrates a transverse section showing an air recovery opening and a filter cleaning unit in accordance with a third preferred embodiment of the present invention.
Figure 10:
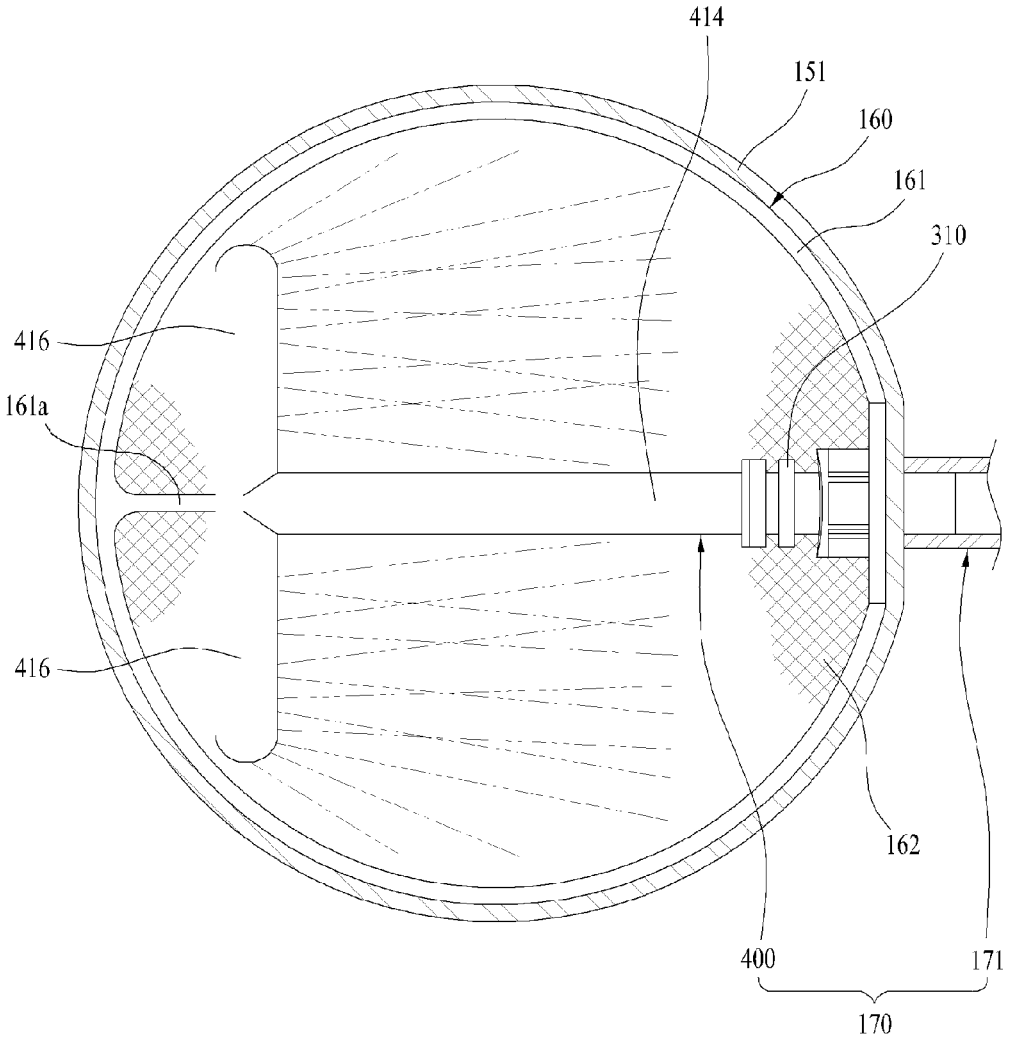
FIG. 10 illustrates a plan view of an air recovery opening and a filter cleaning unit in accordance with a third preferred embodiment of the present invention.

FIG. 9 illustrates a transverse section showing an air recovery opening and a filter cleaning unit in accordance with a third preferred embodiment of the present invention, and FIG. 10 illustrates a plan view of an air recovery opening and a filter cleaning unit in accordance with a third preferred embodiment of the present invention.

Referring to FIGS. 9 and 10, the filter cleaning unit includes a lint filter 160 provided to an inside of the air recovery opening 151 provided to an outside circumferential surface of the tub 120 for filtering the lint produced when heated air is supplied and circulated for drying the laundry, and a filter cleaning unit 170 for cleaning the lint filter 160.

The filter cleaning unit 170 in accordance with a preferred embodiment of the present invention is provided for spraying the cleaning water in a direction from the outside to the inside of the lint filter 160 to drop the lint to the inside of the tub 120 from the lint filter 160.

In the meantime, the filter cleaning unit 170 includes a cleaning water line 171 for supplying the cleaning water, and a distribution nozzle unit 400 for distributing the cleaning water being supplied from the cleaning water line 171 and spraying the cleaning water to the lint filter 160.

In this case, the cleaning water line 171 is configured to supply the cleaning water separate from the washing water supply with a cleaning water valve (Not shown) provided separate from the washing water supply of the water supply unit 113. Since the configuration of the cleaning water line 171 may have numerous variations, detailed description thereof will be omitted.

The distribution nozzle unit 400 is provided to be secured to the inside of the air recovery opening 151 and connected to the cleaning water line 171 for having the cleaning water supplied thereto through the cleaning water line 171 and spraying the cleaning water to an upper side of the filter of the lint filter 160.

The distribution nozzle unit 400 includes a fastening portion 410 for fastening to the air recovery opening 151 detachably, an extension 414 coupled to the fastening portion 410 extended toward the inside of the air recovery opening 151, and a nozzle portion 416 in communication with an end portion of the extension 160 for spraying the cleaning water from an upper end portion of the lint filter 160 toward a lower side of the lint filter 160. In this case, the fastening portion 410, the extension 414, and the nozzle portion 416 are hollow for pass of the cleaning water therethrough.

In the meantime, the air recovery opening 151 has one side having a fastening hole (Not shown) or a fastening recess (Not shown) formed therein for having the fastening portion of the distribution nozzle unit 400 coupled thereto. In this case, the fastening hole or the fastening recess may be a holding step or a thread for securing the fastening portion of the distribution nozzle unit 400 thereto. Since a fastening structure of the fastening hole or the fastening recess may have numerous variations, detailed description thereof will be omitted.

In this case, the fastening portion 410 is detachably mounted to one side of the air recovery opening 151. The fastening portion 410 is hollow cylinder for pass of the cleaning water therethrough. The fastening portion 410 has one end with a line fastening portion 411 for connection to the cleaning water line 171 formed thereon. The fastening portion 410 has the other end with a connection step 413 for having the extension 414 connected thereto. Formed along the circumferential surface between the line fastening portion 411 and the extension 414, there is a securing rib 412 for securing the fastening portion 410 with respect to the air recovery opening 151 when the fastening portion 410 is coupled to the air recovery opening 151.

The extension 414 has a hollow tube shape coupled to the connection step 413 of the fastening portion 410 to form a passage of the cleaning water being supplied through the fastening portion 410. The extension 414 is coupled to the connection step 413 and extended close to an upper side of the lint filter 160 (i.e., a position close to an opposite side of the fastening portion).

And, the nozzle portion 416 is coupled to an end portion 414 of the extension 414 to be in communication thereto, and extended from the end portion of the extension 414 to both sides of the extension 414 parallel to the upper side of the lint filter 160. In this case, the nozzle portion 416 has a length of extension shorter than the first and second nozzle portions 219*a* and 219*b* described in the first embodiment due to the inside circumferential surface of the air recovery opening 151.

In this case, the nozzle portion 416 has a plurality of nozzles (Not shown) for spraying the cleaning water to a lower side of the filter 162 from the upper side of the lint filer 160. In the meantime, since the nozzle portion 416 is positioned at the upper side of the air recovery opening 151, the nozzle portion 160 can not but be formed a little shorter than a width of the lint filter 160. Therefore, the plurality of nozzles formed in the nozzle portion 416 may be slanted the more to spray the cleaning water to an outer side of the lint filter 160 as the nozzles are formed at an outer side of the nozzle portion 416 the more with reference to middle of the nozzle portion 416, i.e., the one pair of nozzle portions include a plurality of nozzles for spraying the cleaning water at a slant to widen spread of the cleaning water in a width direction of the lint filter.

In this case, the cleaning water from the nozzles is sprayed to a fixed area of the filter 162 owing to an angle of the spray from the nozzles and the curve and the slope of the filter 162 of the lint filter 160, thereby separating and removing the lint from the filter 162.

The operation of the filter cleaning unit 170 in accordance with the third preferred embodiment of the present invention will be described.

In a case of the laundry treating machine 100 of the present invention, the filter cleaning unit 170 may be operated for cleaning the lint filter 160 during the washing stroke, the spinning stroke, or the drying stroke. However, it is preferable that the filter cleaning unit 170 is operated in the drying stroke when most of the lint is filtered at the lint filter 160.

In the meantime, the operation process of the filter cleaning unit 170 is as follows. If the cleaning of the lint filter 160 is performed by the filter cleaning unit 170, the cleaning water is supplied through the cleaning water line 171 for cleaning the lint filter 160, and the cleaning water is sprayed from the nozzles through the hollows in the fastening portion 410, the extension 414, and the nozzle portion 416. The cleaning water sprayed from nozzles to clean the lint filter 160 separates and cleans the lint from the lint filter 160

The distribution nozzle unit 400 of the filter cleaning unit 170 is provided to spray the cleaning water downward from the upper side of the lint filter 160 formed in a sloped curve. Accordingly, the cleaning water sprayed toward the upper side of the lint filter 160 is able to flow down to a lower side of the lint filter 160 smoothly owing to the sloped curve of the lint filter 160. That is, since the lint filter 160 is mounted to have one high side with a predetermined curve, the cleaning water sprayed by the distribution nozzle 400 from the upper side of the lint filter 160 is collected at the filter 162 of the lint filter 160, and flows downward along the sloped curve of the filter 162 to the lower side of the lint filter 160.

In the meantime, the cleaning water, sprayed to the lint filter 160 to clean and separate the lint from the lint filter 160, flows down along the inside circumferential surface of the tub 120 together with the lint separated thus and drained to an outside of the laundry treating machine 100 through the drain unit 115 formed under the tub 120.

In this case, the cleaning water flowing down along the inside circumferential surface of the tub 120 is drained while cooling down the inside surface of the tub 120. Eventually, by cooling the inside surface of the tub 120, the cleaning water makes the inside surface of the tub 120 to serve as the condensing surface 126.

In the meantime, in the embodiments described before, the filter cleaning unit 170 is provided to the inside of the air recovery opening 151 for spraying the cleaning water to an inside direction of the tub 120 to clean the lint filter 160. In this case, though most of the cleaning water is sprayed in a tangential direction of the lint filter 160, making most of the cleaning water to flow down toward the lower side of the lint filter 160, there may be cases when a portion of the cleaning water drops to an inside of the tub 120 passed through the lint filter 160. Therefore, a structure may be required to prevent the cleaning water sprayed for removing the lint from the lint filter 160 from dropping down, and introduced to, the tub 130, directly.

Figure 11:
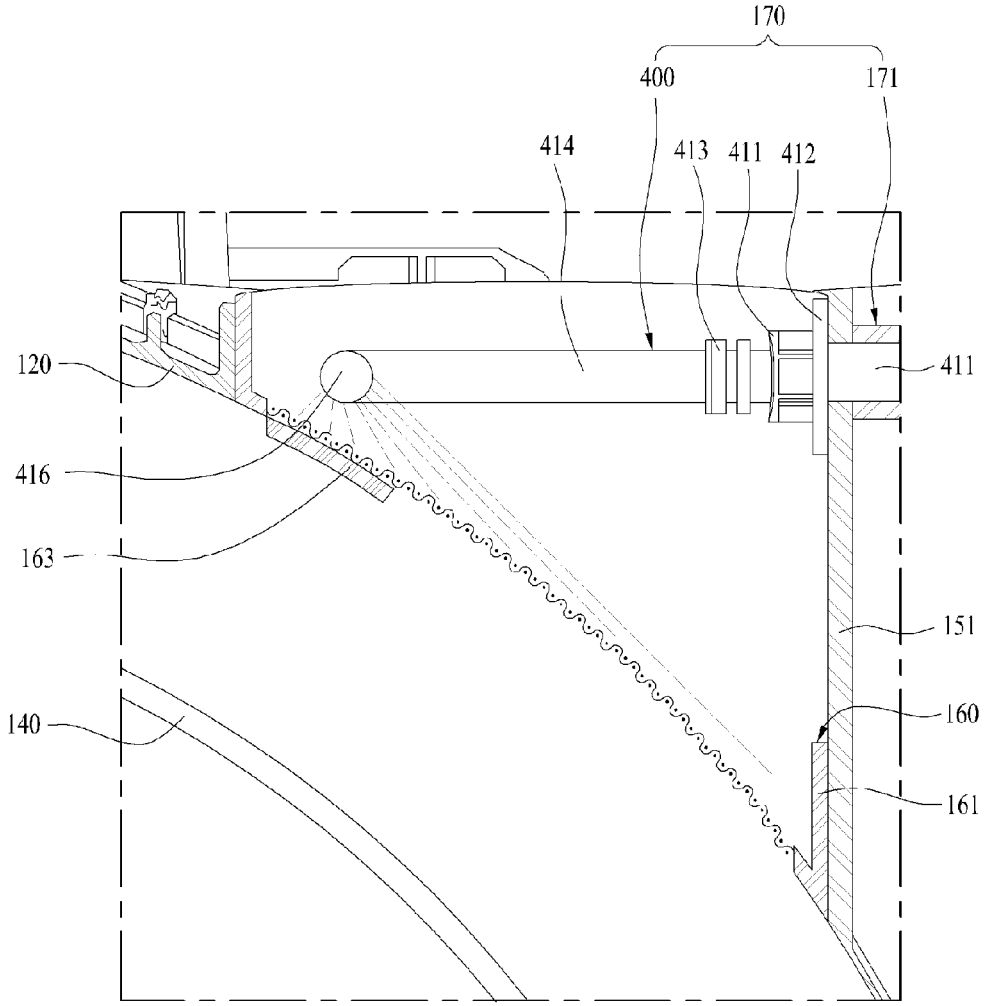
FIG. 11 illustrates a transverse section showing a lint filter in an air recovery unit in accordance with another preferred embodiment of the present invention.

Another preferred embodiment of the lint filter 160 will be described with reference to the attached drawing. FIG. 11 illustrates a transverse section showing a lint filter in an air recovery unit in accordance with another preferred embodiment of the present invention.

Referring to FIG. 11, the lint filter 160 is mounted to an inside of the air recovery opening 151, and the filter cleaning unit 170 is provided to an upper side of the lint filter 160. The filter cleaning unit 170 sprays the cleaning water in a tangential direction of the lint filter for cleaning the lint filter 160.

In this case, the lint filter has the following structure. The lint filter 160 is provided to an inside of the air recovery opening 151 to be inserted therein, detachably. For this, the lint filter 160 has a filter frame 161 having a space for flow of the air therethrough formed in conformity with an inside shape of the air recovery opening 151, and a filter 162 provided to the air flow space of the filter frame 161 for filtering the lint. In this case, it is preferable that the filter 162 has a predetermined curve so as to be extended along a curved shape of an inside circumference of the tub 120.

In the meantime, a reflective plate 163 is formed at a predetermined portion of the filter frame 161 (Preferably a region at which an angle between the lint filter 160 and the cleaning water sprayed from the filter cleaning unit 170 exceeds the tangential angle of the surface of the lint filter 160 excessively) for shielding a portion of the filter 162 to prevent the cleaning water sprayed from the air recovery opening 151 from introducing to the tub, directly. It is preferable that the reflective plate 163 is formed as one unit with the filter frame 161.

Accordingly, the cleaning water sprayed to the region at which an angle between the lint filter 160 and the cleaning water sprayed from the filter cleaning unit 170 exceeds the tangential angle the surface of the lint filter 160 excessively can not pass through the filter by the reflective plate 163, but flows down toward the lower side of the lint filter 160 along the filter 162, thereby preventing the cleaning water from dropping down to the inside of the tub 120.

As has been described, the laundry treating machine of the present invention can improve condensing efficiency and prevent cooling water from wasting by making the inside surface of the tub to serve as a condensing surface for removing moisture from the heated air having the laundry dried thereby, thereby providing a larger condensing area than the condensing structure in the related art.

And, the lint filter provided to the extension plate 340 of the present invention for filtering the lint from the air circulating after drying the laundry can prevent the laundry treating machine from going out of order due to the lint.

And, the filter cleaning structure provided for maintenance of the lint filter which filters the lint from the air circulating after drying the laundry permits easy cleaning of the lint filter.

And, since the cleaning water sprayed to the filter for removing the lint from the lint filter is made to flow down along the inside circumferential surface of the tub to bring about a tub cooling effect, the laundry treating machine of the present invention permits to improve condensing efficiency utilizing the inside surface of the tub.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treating machine comprising:

an air supply unit for supplying air;

a tub for having the air supplied thereto from the air supply unit to treat the laundry, the tub having an air recovery opening formed in an outside circumferential surface thereof for recovery of the air to the air supply unit;

a lint filter unit mounted to an inside of the air recovery opening extended along an inside circumferential surface of the tub for filtering the lint from the air; and a filter cleaning unit including a cleaning water line for supplying the cleaning water and a distribution nozzle unit for spraying the cleaning water being supplied from the cleaning water line for spraying cleaning water from the inside of the air recovery opening toward an inside of the tub and from an upper side of the lint filter unit to separate the lint from the lint filter, wherein the distribution nozzle unit includes:

a fastening portion connected to the cleaning water line fastened to the air recovery opening detachably, an extension coupled to the fastening portion to extend toward the inside of the air recovery opening, and a nozzle portion branched from the extension for spraying the cleaning water to the lint filter, wherein the extension is extended to a position having a largest width of the air recovery opening, and the nozzle portion has first and second nozzle portions extended from an end portion of the extension toward width directions of the air recovery opening, and wherein the first and second nozzle portions include a plurality of nozzles for spraying the cleaning water to a tangential direction of the lint filter.

2. The laundry treating machine as claimed in claim 1, wherein the air supply unit is positioned on an upper side of the tub for supplying the air to a front of the tub, and circulating the air through the air recovery opening.

3. The laundry treating machine as claimed in claim 2, wherein the air supply unit includes:

a fan positioned over the air recovery opening for moving the air, a heating duct for heating the air being moved by the fan, and an air discharge hole for supplying the air heated at the heating duct to the front of the tub.

4. The laundry treating machine as claimed in claim 2, wherein the tub has an inside circumferential surface of the tub used as a condensing surface for condensing moisture contained in the air.

5. The laundry treating machine as claimed in claim 4, wherein the cleaning water sprayed from the filter cleaning unit is used as cooling water for cooling down the condensing surface of the tub.

6. The laundry treating machine as claimed in claim 1, wherein the distribution nozzle unit further includes;

a bend portion coupled to an end of the extension to be rotatable in a vertical direction of the extension and bent toward the lint filter, and a rotatable distribution portion coupled to the bend portion to be rotatable in a horizontal direction of the bend portion for having the first and second nozzle portions coupled thereto to branch and supply the cleaning water.

7. The laundry treating machine as claimed in claim 1, wherein the extension is extended to the other side of the air recovery opening, and the nozzle portion includes one pair of nozzle portions extended from the end of the extension to curve along a curved surface of the inside circumferential surface of the air recovery opening.

8. The laundry treating machine as claimed in claim 7, wherein the one pair of nozzle portions are extended to tilt along a slope of the lint filter.

9. The laundry treating machine as claimed in claim 7, wherein the one pair of nozzle portions include a plurality of nozzles for spraying the cleaning water in a tangential direction of the lint filter.

10. The laundry treating machine as claimed in claim 1, wherein the extension is extended to the other side of the air recovery opening, and the nozzle portion includes one pair of nozzle portions extended perpendicular to the extension from the end of the extension.

11. The laundry treating machine as claimed in claim 10, wherein the one pair of nozzle portions include a plurality of nozzles for spraying the cleaning water at a slant to widen spread of the cleaning water in a width direction of the lint filter.

12. The laundry treating machine as claimed in claim 1, wherein the lint filter unit includes:

a filter frame formed in conformity with an inside shape of the air recovery opening to form a space for flow of the air, and a filter provided to the space in the filter frame for filtering the lint.

13. The laundry treating machine as claimed in claim 12, wherein the filter frame includes a reflective plate for shielding a portion of the filter for preventing the cleaning water sprayed from the filter cleaning unit from introducing to the inside of the tub.

14. The laundry treating machine as claimed in claim 12, wherein the filter frame further includes at least a guide rib extended along the curved slope of the filter.

15. The laundry treating machine as claimed in claim 1, wherein the filter cleaning unit is formed passed through the air recovery opening to position at one side of the air recovery opening.

* * * * *